US009468299B2

(12) United States Patent
Featherstone

(10) Patent No.: US 9,468,299 B2
(45) Date of Patent: Oct. 18, 2016

(54) CUSHIONS FOR RELIEVING SCIATIC AND/OR PERINEUM PRESSURE

(71) Applicant: HEAVY FEATHER, LLC, Henderson, NV (US)

(72) Inventor: Richard Featherstone, Henderson, NV (US)

(73) Assignee: HEAVY FEATHER, LLC, Henderson, NV (US)

( * ) Notice: Subject to any disclaimer, the term of this patent is extended or adjusted under 35 U.S.C. 154(b) by 8 days.

(21) Appl. No.: 14/446,038

(22) Filed: Jul. 29, 2014

(65) Prior Publication Data

US 2015/0061346 A1 Mar. 5, 2015

Related U.S. Application Data

(60) Provisional application No. 61/874,276, filed on Sep. 5, 2013.

(51) Int. Cl.
*A47C 7/02* (2006.01)
*A47C 7/14* (2006.01)

(52) U.S. Cl.
CPC *A47C 7/021* (2013.01); *A47C 7/14* (2013.01)

(58) Field of Classification Search
CPC ..... A47C 7/021; A47C 7/14; A47C 7/16; A47C 7/18; A47C 7/02; A47C 27/00; A47C 27/081; A61G 5/1043; A61G 2005/1045
See application file for complete search history.

(56) References Cited

U.S. PATENT DOCUMENTS

D33,543 S * 11/1900 Hogan ..... D6/604
D33,613 S * 11/1900 Hogan ..... D6/604
679,915 A * 8/1901 Rudolf ..... A47C 7/021 297/452.26
682,871 A * 9/1901 Hogan ..... 34/65
1,218,291 A * 3/1917 Meinecke ..... A47C 27/081 114/219
1,382,531 A * 6/1921 Newborn ..... A47C 27/081 5/644
1,468,072 A * 9/1923 Ogle ..... A47C 7/021 128/889
1,673,636 A * 6/1928 Perry ..... A47C 7/021 267/117
1,726,939 A * 9/1929 Anderson ..... A47C 7/021 267/117
2,156,629 A * 5/1939 Hutchison ..... A47C 7/021 297/219.1
2,260,437 A * 10/1941 Chambers ..... A47C 7/021 4/456
2,728,926 A * 1/1956 Emery ..... A47G 9/10 5/644
3,056,980 A * 10/1962 Holladay ..... A47C 27/081 156/292
3,205,010 A * 9/1965 Schick ..... A47C 7/021 297/284.1
3,222,694 A * 12/1965 Schick ..... A47C 7/021 297/219.1

(Continued)

*Primary Examiner* — David E Sosnowski
*Assistant Examiner* — Eric Kurilla
(74) *Attorney, Agent, or Firm* — Phillips Ryther & Winchester; Matthew D. Thayne

(57) ABSTRACT

Cushions configured to relieve pressure on the piriformis muscle/sciatic nerve area and/or perineum pressure. In some embodiments, a cushion may comprise a first lobe and a second lobe connected by a bridge region to define a low-profile region. The width of the entire cushion may be limited to reduce or eliminate pressure on the hollow of the buttocks, the location of the sciatic nerve, and piriformis muscle. In some embodiments, the cushion may comprise a rear seat portion configured to support a user's buttocks during use and a front seat portion configured to support a user's legs. The front seat portion may have a greater width than the rear seat portion to further reduce or eliminate pressure on the perineum region.

20 Claims, 8 Drawing Sheets

(56) References Cited

U.S. PATENT DOCUMENTS 3,296,635 A * 1/1967 O'Hanlan ..... A47C 7/021 297/219.1
3,382,511 A * 5/1968 Brooks ..... A47C 7/18 5/652
3,513,491 A * 5/1970 Gordon ..... A47C 27/00 182/137
3,514,793 A * 6/1970 West ..... A47C 7/021 4/239
3,529,306 A * 9/1970 Thorne ..... A41D 31/02 2/411
3,644,949 A * 2/1972 Diamond ..... A47C 20/04 5/630
4,047,757 A * 9/1977 Eames ..... A47C 7/021 297/230.12
4,132,228 A * 1/1979 Green ..... A47C 7/022 297/284.3
4,164,798 A * 8/1979 Weber ..... A47C 7/022 297/452.26
D255,966 S * 7/1980 Stadel ..... 5/644
4,234,981 A * 11/1980 Hanson ..... A47C 27/00 5/411
4,290,155 A * 9/1981 Hanson ..... A47C 15/008 5/722
4,370,769 A * 2/1983 Herzig ..... A47C 7/021 297/452.41
4,405,129 A * 9/1983 Stuckey ..... A63B 21/0085 482/112
4,643,481 A * 2/1987 Saloff ..... A61G 5/1043 297/452.25
4,698,864 A * 10/1987 Graebe ..... A47C 27/081 297/DIG. 3
4,824,174 A * 4/1989 Dunn, Sr. ..... A47C 7/022 297/452.22
4,951,334 A * 8/1990 Maier ..... A61G 5/1043 297/452.21
4,996,721 A * 3/1991 Beshro ..... A41D 15/04 2/19
5,105,489 A * 4/1992 Meyer ..... A61F 5/01 297/452.23
5,154,649 A * 10/1992 Pender ..... A47D 13/083 5/490
5,231,720 A * 8/1993 Benoff ..... A47C 27/081 5/638
5,282,286 A * 2/1994 MacLeish ..... A47C 4/54 297/469
5,402,545 A * 4/1995 Jolley ..... A47C 7/022 297/467
5,513,899 A * 5/1996 Michaels ..... A47C 7/021 297/452.25
5,634,224 A * 6/1997 Gates ..... A47C 27/081 5/654
5,681,092 A * 10/1997 Hanson ..... A61G 5/1043 297/284.9
D396,980 S * 8/1998 Novros ..... D6/601
5,918,334 A * 7/1999 Laidlaw ..... A47C 7/021 297/452.25
D416,745 S * 11/1999 Noyes ..... D6/601
6,009,578 A * 1/2000 Davis ..... A47C 7/021 297/219.1
D445,624 S * 7/2001 Futagami ..... 5/644
6,327,715 B1 * 12/2001 Castiglione ..... A41D 1/082 2/227
6,327,724 B1 * 12/2001 Sharrock ..... A61G 7/07 5/630
6,413,194 B1 * 7/2002 Gant ..... A47C 7/021 482/112
6,457,773 B1 * 10/2002 Gates ..... A47C 7/021 297/219.1
6,581,227 B1 * 6/2003 Obermaier ..... A47C 7/022 5/653
6,820,938 B2 * 11/2004 Barrett ..... A47C 7/022 297/4
7,024,714 B1 * 4/2006 Yates ..... A47C 7/022 297/452.23
D582,713 S * 12/2008 Baldwin ..... D6/601
D637,439 S * 5/2011 Mettler ..... D6/601
D663,564 S * 7/2012 Sclare ..... D6/601
D672,596 S * 12/2012 Sclare ..... D6/601
9,021,637 B1 * 5/2015 Whelan ..... A61G 5/1043 297/452.25
2001/0040402 A1 * 11/2001 Odderson ..... A47C 7/024 297/452.21
2004/0195898 A1 * 10/2004 Barrett ..... A47C 7/022 297/452.1
2005/0056314 A1 * 3/2005 Lin ..... A47C 27/081 137/223
2006/0012227 A1 * 1/2006 Obermaier ..... A47C 7/022 297/219.1
2008/0196166 A1 * 8/2008 Fraser ..... A47C 7/021 5/654
2009/0260639 A1 * 10/2009 Hsu ..... A61F 13/02 128/888
2010/0026077 A1 * 2/2010 Tarumi ..... A47C 7/021 297/452.62
2013/0198961 A1 * 8/2013 Davis ..... A47C 7/62 5/648
2013/0226053 A1 * 8/2013 Khan ..... A47C 7/021 601/134
2013/0257132 A1 * 10/2013 Chen ..... A47C 7/022 297/452.21
2013/0318723 A1 * 12/2013 Li ..... A47C 7/021 5/654
2014/0007351 A1 * 1/2014 Cohen ..... A47G 9/10 5/639
2014/0345058 A1 * 11/2014 Escobedo ..... A61G 7/05769 5/655.3
2015/0108802 A1 * 4/2015 Krishtul ..... A47C 7/022 297/283.1

* cited by examiner

CUSHIONS FOR RELIEVING SCIATIC AND/OR PERINEUM PRESSURE

RELATED APPLICATIONS

This application claims the benefit under 35 U.S.C. §119 (e) of U.S. Provisional Patent Application No. 61/874,276 filed Sep. 5, 2013 and titled "CUSHIONS FOR RELIEVING SCIATIC AND/OR PERINEUM PRESSURE," which application is incorporated herein by reference in its entirety.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1A:
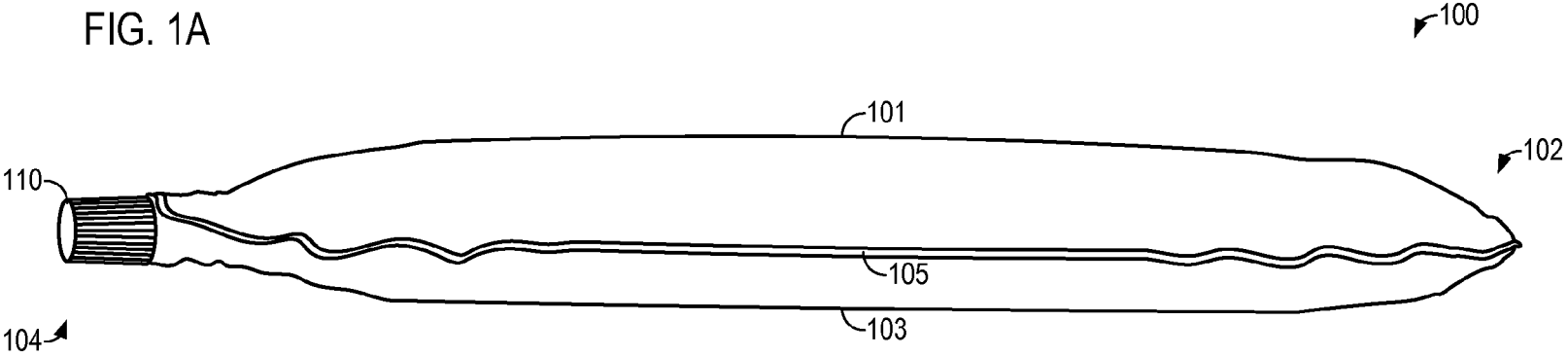
FIG. 1A illustrates a side view of an inflatable cushion for relieving pressure in the piriformis muscle/sciatic nerve area and/or perineum pressure in an inflated configuration.

The present disclosure provides various embodiments and variations of cushions configured to relieve pressure in the perineum region and/or on the sciatic nerve when sitting. In some embodiments, the cushion may be inflatable. In some such embodiments, the cushion may be self-inflating. In other embodiments, the cushion may be non-inflating, but rather multilayered for variability in support and pressure relief.

In various embodiments, a cushion may comprise a first lobe and a second lobe connected by a bridge region to define a low-profile region. A valve may allow air to inflate and deflate one or more internal pockets or cavities within the cushion. In some embodiments, such pockets or cavities may be hermetically sealed. The cushion may include any number of hermitically sealed pockets or cells, each of which may have their own valve. The first and second lobes may be configured to support the ischial tuberosities and narrow enough to facilitate reduction or elimination of pressure on the piriformis muscle and sciatic nerve at the hollow of the buttocks of a user, while a low-profile region may facilitate reduction or elimination of pressure on the perineum region.

In some embodiments, a solid rear section may be provided that may support the ischial tuberosities. This solid rear section may be narrow enough to facilitate reduction or elimination of pressure on the piriformis muscle and sciatic nerve at the hollow of the buttocks of a user, whereas lobes may also be provided that may be located in the front of the device to support the user's legs. In some embodiments, a low-profile region may also be provided to facilitate reduction or elimination of pressure on the perineum region.

Other embodiments may comprise a sealed seam that replaces the space adjacent to the perineum region to relieve pressure in this region. Certain embodiments may also, or alternatively, be tapered or wedge shaped from back to front in order to arch the user's lower back. In some such embodiments, the taper may extend from back to front such that the cushion is thickest in the back and thinner in the front. In alternative embodiments, the taper may extend in the opposite direction. Such tapers may extend along the entire length of the cushion, or along only a portion of the cushion. Alternatively, the cushion may be thinner in the front (or vice versa) by forming a step or other transition in height rather than a taper.

According to some embodiments, an upper surface and a lower surface may be interchangeable, such that a user may sit on either surface with the opposing surface supported by an underlying support platform. In other embodiments, an upper surface may be specifically adapted for a user to sit on and/or a lower surface may be specifically adapted to engage or otherwise accommodate another structure, such as a support platform.

For example, the upper surface may comprise an outer shell or covering that is removable, washable, provides a gripping surface, is soft to the touch, and/or otherwise engages with or provides a convenience to a user. As another example, the lower surface may be configured to provide a frictional surface for engaging another structure, such as an underlying support platform. In some embodiments, a rubberized lower surface, a hook and loop (e.g., VELCRO™) system, and/or other high friction or securing feature may be present on the lower surface. In some embodiments, the lower surface may comprise a rigid member, such as a cardboard, metal, plastic, or other rigid component to provide additional support. In such embodiments, the first and second lobes and/or the bridge may inflate up from the lower rigid component.

A cushion, according to any of the embodiments described herein, may be integrated within a seat, such as an office chair, a car seat, a bench, a chair, a sofa, a recliner, a couch, and/or the like. Alternatively, a cushion may be secured to or rested upon any of a variety of support platforms. For example, straps, an adhesive, a hook and loop system (or just one portion of a hook and loop system), or another similar means for coupling the cushion with a support platform may be provided. Examples of such platforms include, but are not limited to, chairs, car seats, benches, bicycle seats, etc.

Some of the infrastructure, materials, construction techniques, accessories, valves, nozzles, and other components that can be used with embodiments disclosed herein are already available. Accordingly, it will be appreciated that numerous variations, substitutions, replacements, and/or combinations are possible.

Some embodiments may also comprise one or more elements used to deliver heat and/or cooling to one or more locations on the cushion. For example, some embodiments may be configured with one or more built-in heat packs, such as a calcium chloride pack comprising separate pouches of solid calcium chloride in one pouch, such as an outer pouch, and another pouch, such as an inner pouch comprising water or another fluid or chemical configured to initiate a chemical reaction that generates heat. Such embodiments may be used to provide additional relief/treatment directed to one or more specific areas on the pouch, such as, for example, a location configured to contact an area of a user adjacent to an ischial tuberosity when the user sits on the cushion. Other embodiments may similarly be configured to deliver a cooling, or a combination of heat and cold in selected areas.

The embodiments of the disclosure will be best understood by reference to the drawings, wherein like parts are designated by like numerals throughout. The components of the disclosed embodiments, as generally described and illustrated in the figures herein, could be arranged and designed in a wide variety of different configurations. Furthermore, the features, structures, and operations associated with one embodiment may be applicable to or combined with the features, structures, or operations described in conjunction with another embodiment. In other instances, well-known structures, materials, or operations are not shown or described in detail to avoid obscuring aspects of this disclosure.

Thus, the following detailed description of the embodiments of the systems and methods of the disclosure is not intended to limit the scope of the disclosure, as claimed, but is merely representative of possible embodiments.

FIG. 1A illustrates a side view of an inflatable cushion 100 for relieving pressure in the piriformis muscle/sciatic nerve area and perineum pressure in an inflated configuration. FIG. 1A depicts cushion 100 in an inflated configuration. According to various embodiments, cushion 100 may be configured as an inflatable cushion that may be automatically or manually inflated with a gas, such as air. In alternative embodiments, a cushion may be filled or stuffed with a compressible material or semi-compressible material, such as foam or gel.

In some embodiments, cushion 100 may comprise a compressible material and also be inflatable with a gas. For example, one or more inflatable cells may be encapsulated or partially encapsulated by foam (in some embodiments a memory foam), rubber, or another compressible material. In some embodiments, the foam, rubber, or other compressible material may be included on all surfaces, only an upper surface or portion thereof, only a bottom surface or portion thereof, and/or only a side surface or portion thereof.

In various embodiments, the cushion 100, once inflated, may be between about 1 and about 3 inches thick. It may be desirable to select a thickness that provides sufficient compressibility and comfort, while remaining stable enough for a user to sit on the inflated cushion 100 without difficulty and/or falling. In the illustrated embodiment, the inflated cushion 100 is shown as approximately 1.75 inches thick.

Cushion 100 may comprise a proximal end 102 and a distal end 104. The distal end 104 may comprise a valve system 110 that is configured for inflating and/or deflating the cushion 100. The cushion 100 may also comprise a top surface 101 and a bottom surface 103. In some embodiments, the top surface 101 and the bottom surface 103 may be joined at a hermetically sealed seam 105 on an outer circumference, as illustrated. In other embodiments, the seam 105 may be smaller, internal, positioned on an inner circumference, and/or made unnecessary based on the construction techniques used.

The valve 110 may incorporate any of a wide variety of valve connection types and/or operational types. For example, the valve 110 may be configured to interface with an external inflator/deflator (e.g., a pump or user's mouth). Alternatively, the valve 110 may be a self-inflating valve configured to automatically inflate the cushion 100 when opened. In some embodiments, the valve may be configured to self-inflate or receive a gas (e.g., air) from an external inflator. In some embodiments, the cushion may be configured to allow a user to either inflate the cushion manually or use a self-inflating mechanism. A self-inflating valve 110 may function independent of the cushion 100, or be configured as a self-inflating valve 110 that is incorporated into the design of the cushion 100.

Without limitation, the valve 110 may be configured with a connection type to interface with any of a wide variety of external inflating devices. For example, the valve 110 may be configured with a Shrader connection, a Presta connection, a Woods Connection, a Regina connection, or other standardized or custom connection type.

The cushion 100 may be constructed of any of a wide variety of materials. For example, one or more internal pockets or cells may be hermetically sealed and configured to maintain the cushion 100 in an inflated configuration. The one or more internal pockets or cells may be filled by a single valve 110 or multiple valves (not shown) may be used to inflate the cushion. In embodiments comprising multiple valves, a user may be able to provide a customized inflation state that may be most comfortable and/or most suitable to ameliorating a particular sciatic or other similar condition. For example, some embodiments may allow a user to vary the pressure more on one side relative to the other side so provide additional relief for users whose pain tends to be most prevalent on one side of the back/body. The one or more internal and hermetically sealed pockets or cells may be formed of any of a wide variety of materials, including those formed using fabrics, plastics, nylons, polyesters, metals, and other materials, such as polyethylene and other monomers.

One or more interfacing layers or compressible materials may surround all or a part of the one or more internal and hermetically sealed pockets or cells. For example, a compressible material, such as a foam for example, may surround all or a part of the one or more internal pockets or cells. An interfacing layer, such as a fabric, leather, plastic, vinyl, cloth, rubber or other material may be used as an outer shell to interface with a user and/or an external or peripheral structure or device, such as an underlying support platform. Multiple, different interfacing layers may be used on different parts or regions of the cushion 100 if desired.

Figure 1B:
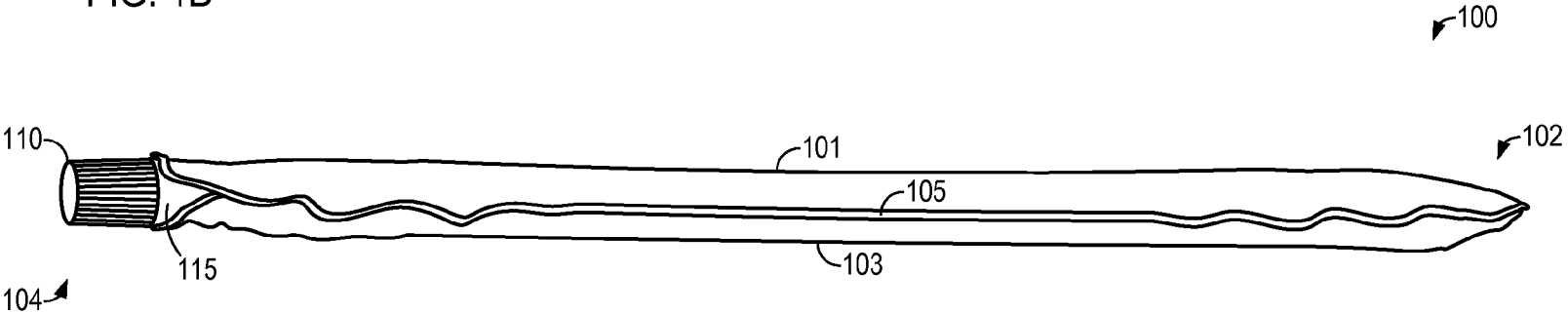
FIG. 1B illustrates a side view of the inflatable cushion of FIG. 1A shown in a deflated configuration.

FIG. 1B illustrates the cushion 100 in a deflated state. The deflated cushion may be between about 0.1 and about 0.75 inches thick. The thickness may be less if thinner materials are used, and may be greater if thicker materials are used and/or additional interfacing layers and/or compressible materials are used.

In a deflated state, as illustrated in FIG. 1B, the inflating air is expelled and the resulting thickness may be attributable to only the internal hermetically sealed layer and the outer shell or interfacing layer. In some embodiments, the internal hermetically sealed layer and the outer shell or interfacing layer may be a single layer. Although the valve 110 is illustrated as circular, the valve 110 may be any shape and/or size. Additionally, while the valve 110 is shown as connected to the cushion 100 via a neck region 115, the valve 110 may be repositioned to any location on cushion 100. In one embodiment, the valve 110 may be located internally, in which case the neck region 115 may be removed.

Figure 2:
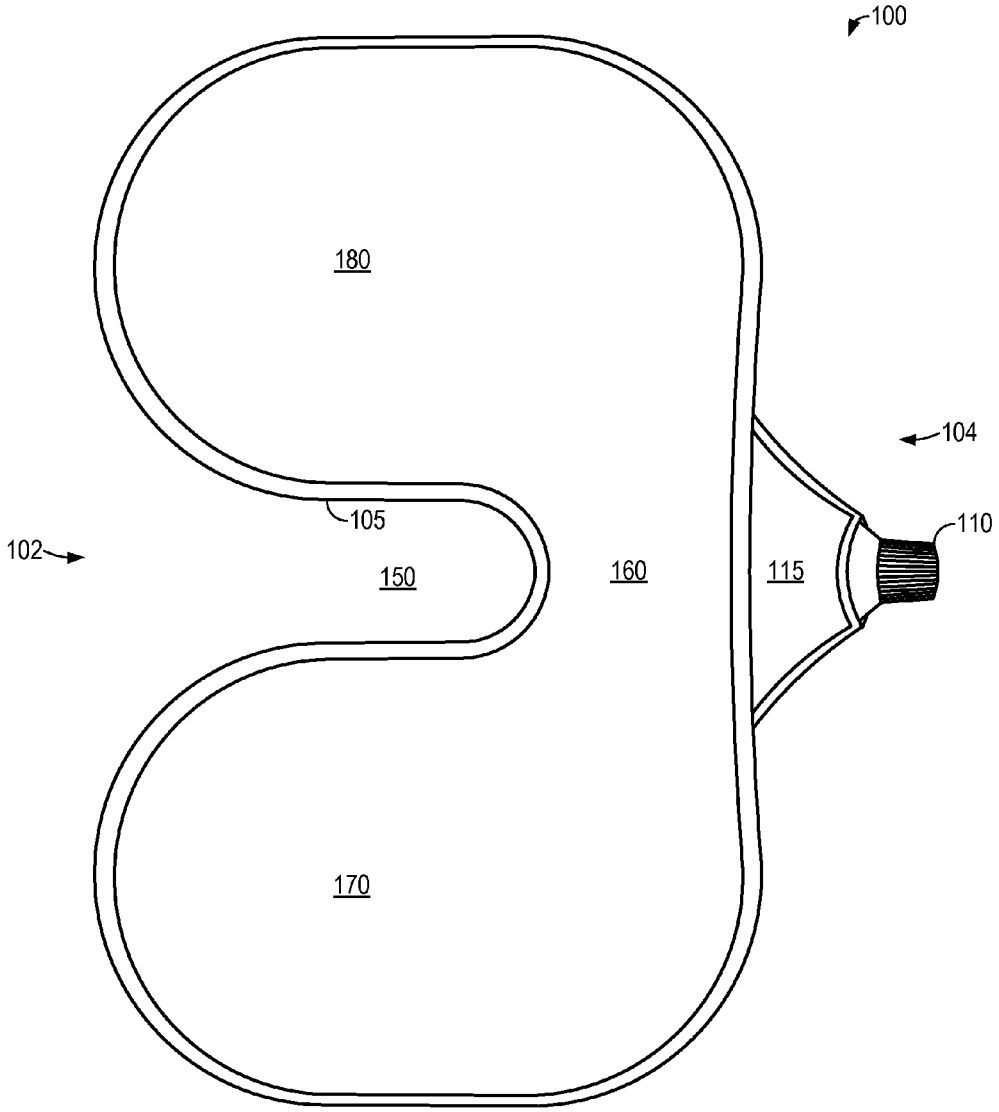
FIG. 2 illustrates a top view of a cushion for relieving pressure in the piriformis muscle/sciatic nerve area and/or perineum pressure in an inflated configuration.

FIG. 2 illustrates a top (or bottom) view of cushion 100. As illustrated, the cushion 100 may comprise an upper surface comprising a first lobe 170 and a second lobe 180.

A bridge region 160 may join the first and second lobes 170 and 180. The size of the first and second lobes 170 and 180, respectively, may determine the length and width of a low-profile region 150 defined by first and second lobes 170 and 180. A valve 110, such as a self-inflating valve, may be connected to the distal 104 end of the bridge region 160 by a neck region 115.

In alternative embodiments, the neck region 115 may be removed and/or the valve 110 may be repositioned to another location on one or both of the lobes 170 and 180 and/or the bridge region 160. For example, the valve 110 may be repositioned internally or on an inner wall within the low-profile region 150. As previously described, the cushion 100 may include an upper surface and a lower surface joined at a seam 105. The seam may extend around the periphery of the cushion 100, extend partially around the periphery of the cushion 100, extend from the periphery of the cushion 100, and/or protrude into the cushion around the periphery of the cushion 100. As also mentioned, other embodiments are contemplated in which seam 105 may be omitted.

A user may sit on the cushion 100 with the distal end 104 toward the spine of the user and the proximal end 102 towards the thighs of the user. The first and second lobes 170 and 180 may support the ischial tuberosities. The low-profile region 150 may be configured to provide relief to the perineum region by reducing pressure, reducing compression, and/or not impeding blood flow in regions associated with the perineum.

The length and width of each lobe 170 and 180 and the length of the bridge region 160 may determine the length and width of the low-profile region 150. In some embodiments, the cushion 100 may be custom sized for each user. In some embodiments, the cushion 100 may be configured to expand based on pressure of the inflating air. In such an embodiment, the cushion 100 may have recommended inflation settings based on the dimensions of relevant features, such as the size of the user, which may relate to the width of the ischial tuberosities. In some embodiments, the cushion 100 may be manufactured in multiple sizes, each size accommodating a size range of users.

In the illustrated embodiment, the length of the cushion 100 from the distal end 104 to the proximal end 102, excluding the neck region 115 may be approximately 5-8 inches. The width of the cushion from the outer edge of the first lobe 170 to the outer edge of the second lobe 180 may be approximately 10-14 inches. The first and second lobes 170 and 180 may be symmetrical and may each have a width of approximately 4-6 inches, such that the low-profile region 150 is approximately 0-2 inches wide, depending upon whether the low-profile region is designed with a gap that prevents the two opposing lobes from touching or, alternatively, a seam that reduces the profile of the cushion in a center region of the cushion. In some embodiments, the bridge region 160 may be approximately 2 inches wide from its distal end to its proximal end, such that the low-profile region 150 is approximately 4 inches long.

In some embodiments, the first and second lobes 170 and 180 and/or the bridge region 160 may be rounded. Accordingly, the low-profile region 150 may have a varying width based on the curvature and separation of the lobes 170 and 180. In some embodiments, low-profile region 150 may be configured with a feature that reduces the profile of the cushion in that region but without providing an opening through the cushion. In order words, some embodiments may comprise a low-profile region that comprises, for example, opposing lobes that are in contact with one another within the low-profile region. This may be accomplished, for example, by positioning a seam in the low-profile region to separate the lobes and reduce the height of the cushion in this region. In various illustrations, the seal 105 is shown outside the described dimensions. In some embodiments, however, the seal 105 may be shorter, less obtrusive, and/or extend internally.

It will be appreciated by one of skill in the art that the exact dimensions may be varied based on the dimensions of a specific user and/or varied slightly for any given user without significantly departing from the purpose of the cushion 100. For example, the width of the cushion 100 may be slightly longer (extending further down the thighs of user) or slightly shorter without materially impacting the functionality of the cushion 100.

In some embodiments, the bridge region 160 may be slightly depressed or thinner than the first and second lobes 170 and 180, such that weight of the user is distributed solely, or at least primarily, via the first and second lobes 170 and 180. In other embodiments, the first and second lobes 170 and 180 may be connected via a non-inflatable bridge region 160. Alternatively, bridge region 160 may be configured to be inflated but to a lesser extent than first and second lobes 170 and 180.

Additionally, the first and second lobes 170 and 180 and/or bridge region 160 may be jointly inflated or separately inflated and formed as hermitically distinct cells or pockets. In such embodiments, the first and second lobes 170 and 180 may be asymmetrically inflated to accommodate users with special needs or those with asymmetrical pelvic anatomy. Multiple valves 110 may be used in such embodiments.

Figure 3:
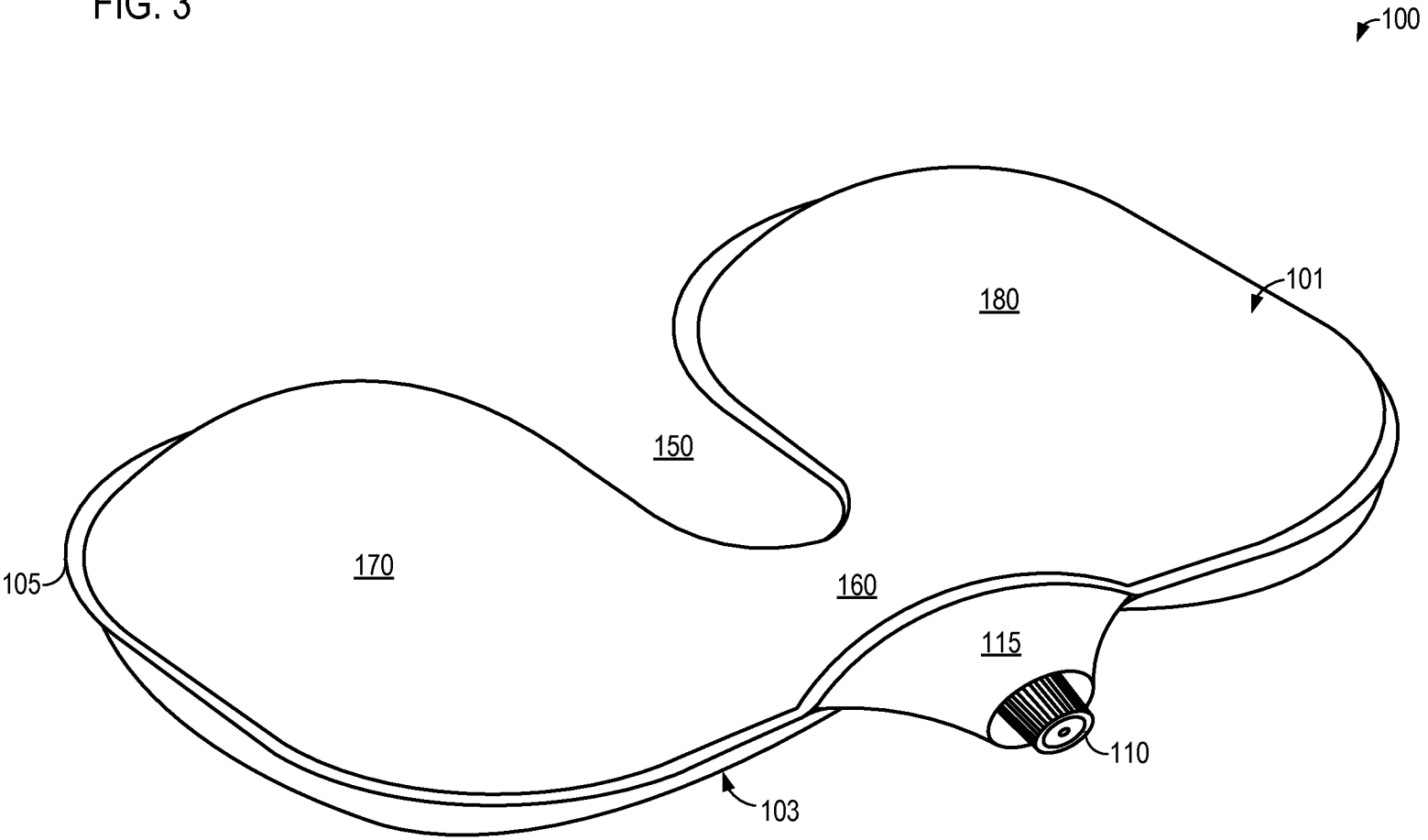
FIG. 3 illustrates a rear perspective view of a cushion for relieving pressure in the piriformis muscle/sciatic nerve area and/or perineum pressure in an inflated configuration.

FIG. 3 illustrates a rear perspective view of a cushion 100 for relieving sciatic nerve and/or perineum pressure while sitting. As previously described, a user may sit on the cushion 100 with the first and second lobes 170 and 180 supporting the ischial tuberosities of the user without putting pressure, or at least to facilitate reduction of pressure, on the perineum region and/or hollow of the buttocks, the location of the sciatic nerve and piriformis muscle.

According to various embodiments, an upper surface 101 and a lower surface 103 may be interchangeable, such that a user may sit on either surface 101 or 103 with the opposing surface supported by an underlying support platform. In other embodiments, an upper surface 101 may be specifically adapted for a user to sit on and/or a lower surface 103 may be specifically adapted to engage or otherwise accommodate a support platform.

For example, in some embodiments, the upper surface 101 of the cushion 100 may be configured with convex or concave lobes 170 and/or 180 configured to receive a user's ischial tuberosity or surrounding regions. The upper surface 101 may include an outer shell or covering that is removable, washable, provides a gripping surface, is soft to the touch, and/or otherwise engages with or provides a convenience to a user.

In some embodiments, the lower surface 103 may be configured to provide a low friction or high friction surface for engaging an underlying support platform, depending on the application. For instance, in some embodiments, a rubberized lower surface 103, a hook and loop (e.g., VELCRO) system, and/or other high friction or securing feature may be present on the lower surface 103. In some embodiments, the lower surface 103 may comprise a rigid member, such as a cardboard, metal, plastic, or other rigid component to provide additional support. In such embodiments, the first and second lobes 170 and 180 may inflate up from the lower rigid component.

Figure 4:
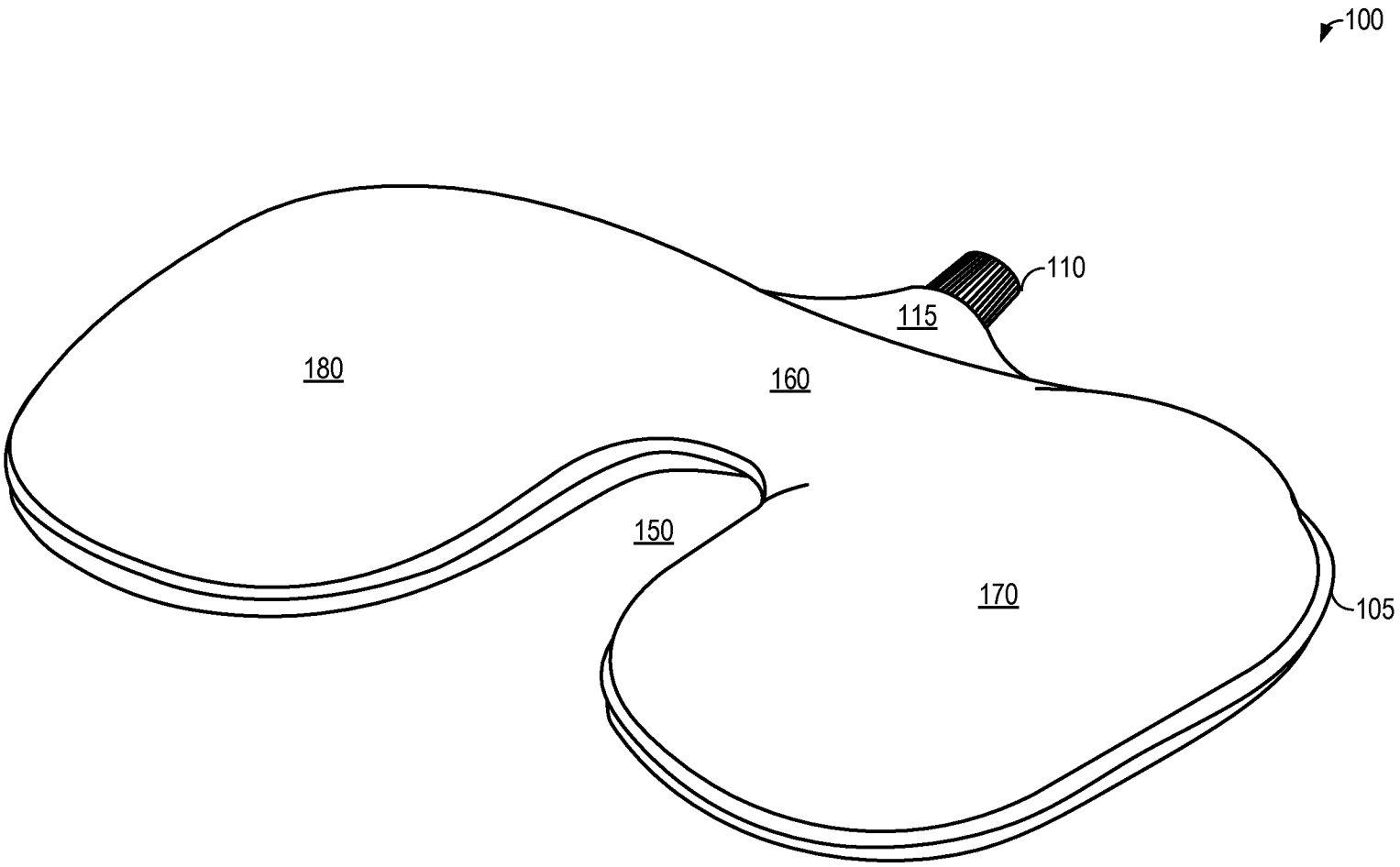
FIG. 4 illustrates a front perspective view of a cushion for relieving pressure in the piriformis muscle/sciatic nerve area and/or perineum pressure in an inflated configuration.

FIG. 4 illustrates a front perspective view of cushion 100. Various features, such as the exact size of the various portions of the cushion 100, relative dimensions of the cushion 100, position and configuration of the seam 105, construction techniques of the cushion 100, number of distinct sections connected together to form the cushion 100, and/or the thickness of the cushion 100 may be modified and/or adapted for a specific user, usage situation, cost effectiveness, manufacturing considerations, and/or other considerations.

Figure 5:
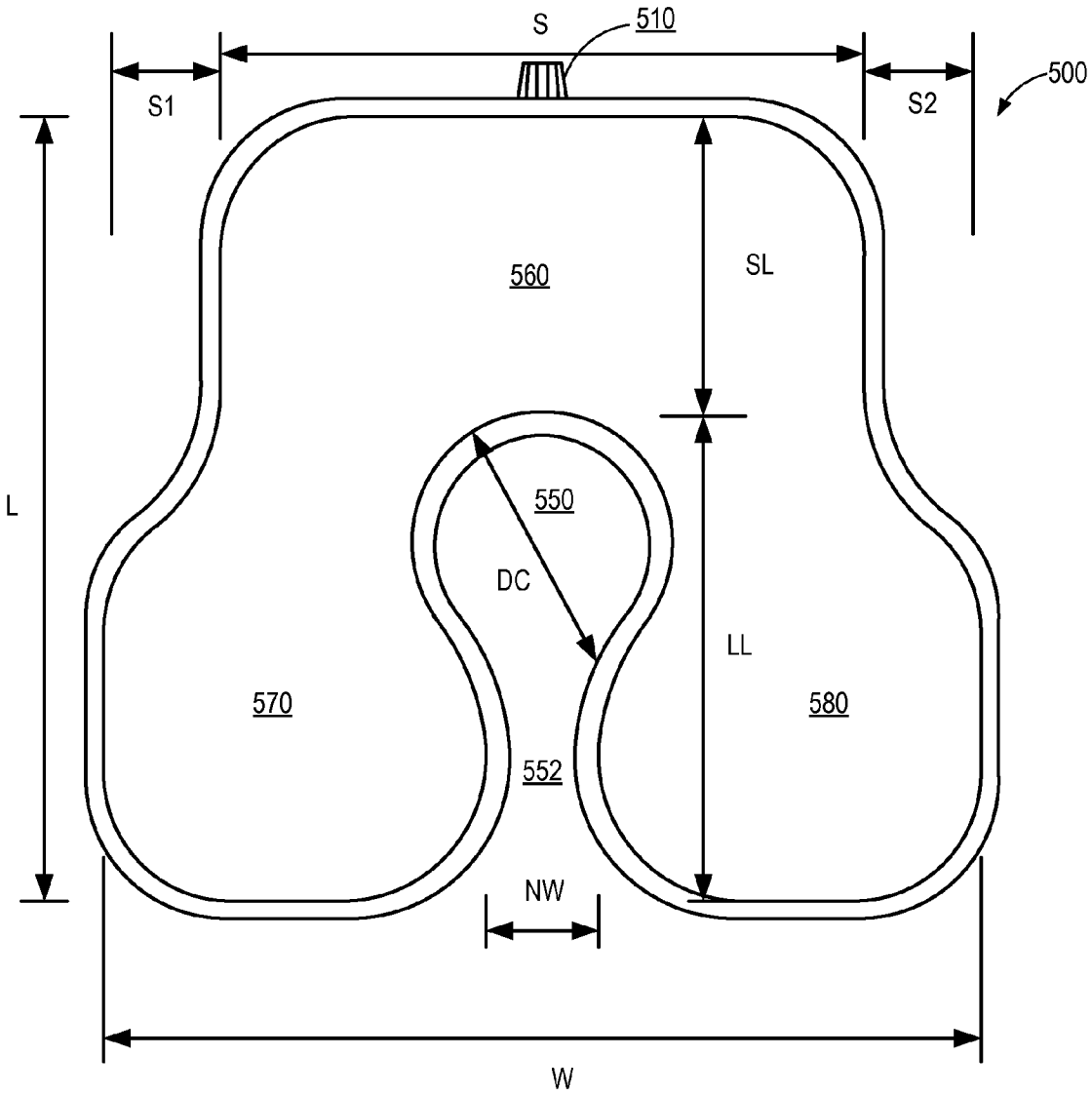
FIG. 5 illustrates a top view of another embodiment of a cushion for relieving pressure in the piriformis muscle/sciatic nerve area and/or perineum pressure.

FIG. 5 illustrates a top view of an alternative embodiment of a cushion 500. As with cushion 100, cushion 500 may be configured to be integrated with, be inserted within, be secured to, or rest on one or more accessories or other peripheral structures, such as an underlying support platform. Cushion 500 may also be configured as an inflatable cushion that may be automatically or manually inflated with a gas, such as air. In some such embodiments, cushion 500 may be self-inflating. In alternative embodiments, a cushion may be filled or stuffed with a compressible material or semi-compressible material, such as foam or gel. However, cushion 500 differs from cushion 100 in that cushion 500 comprises a unique shape intended to provide additional comfort and/or additional pressure relief in the perineum region and/or on the sciatic nerve when a user sits on cushion 500.

More particularly, cushion 500 comprises an upper surface comprising a first lobe 570 and a second lobe 580, both of which comprise narrow regions adjacent to a rear seat portion 560 of cushion 500 and widened regions towards the front of cushion 500. Lobes 570 and 580 are separated by a low-profile region 550. Cushion 500 comprises a low-profile region 550 that completely separates lobes 570 and 580. In other words, low-profile region 550 comprises an empty region positioned in between lobes 570 and 580. However, alternative embodiments are contemplated in which low-profile region 550 comprises a region in which lobes 570 and 580 are directly attached to one another (rather than spaced apart), but in which the height of the cushion is reduced.

It can also be seen in FIG. 5 that low-profile region 550 comprises a curved region immediately adjacent to seat portion 560. In the depicted embodiment, this curved region comprises an at least partially circular shape. However, other embodiments are contemplated in which this region is curved but not circular, or not curved at all. Low-profile region 550 also comprises a narrowed region 552 positioned towards the front of cushion 500 relative to the circular region of low-profile region 550. This provides a "key-hole"-like shape to low-profile region 550.

It can also be seen in FIG. 5 that lobes 570 and 580 are not only widened into low-profile region to create narrowed region 552, but are also widened on the sides opposite to the sides defining narrowed region 552 such that both lobes 570 and 580 extend beyond the outer edge or width of seat portion 560.

Figure 6:
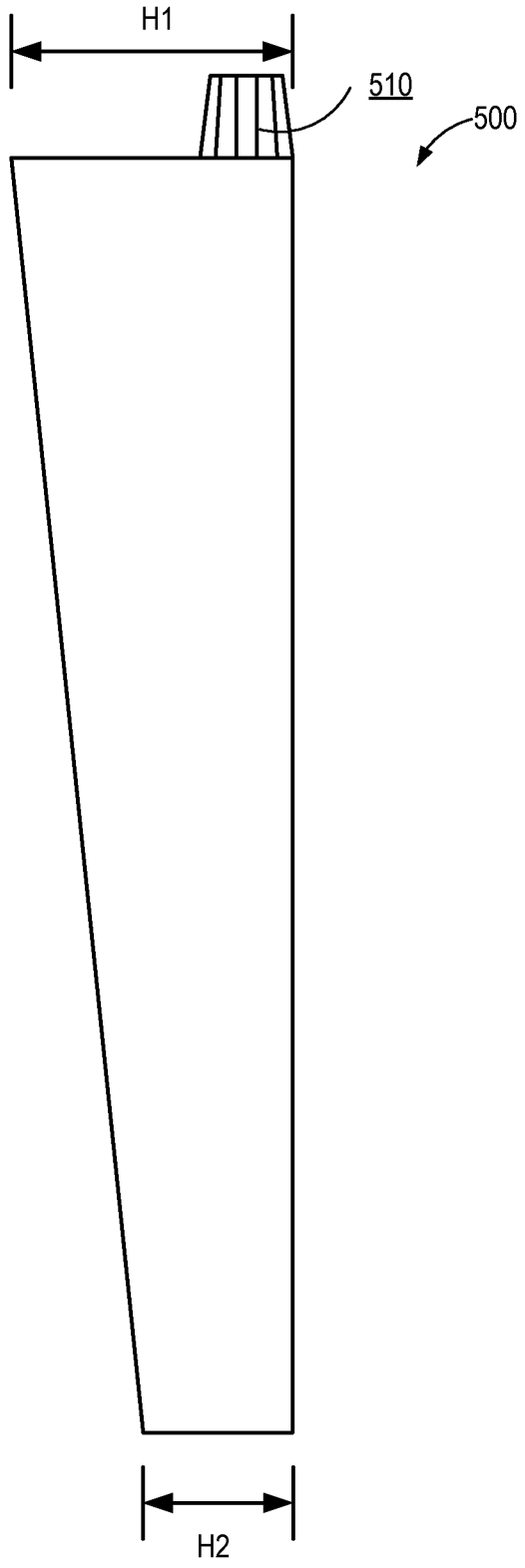
FIG. 6 illustrates a side view of the cushion of FIG. 5.

Cushion 500 also comprises a tapered or wedge shape, as depicted in the side view of FIG. 6. More particularly, cushion 500 is tapered or wedge shaped from the back to the front of cushion 500 (with the back having the greatest height and the front having the smallest height). This may be helpful in creating an arch for the user's lower back. In alternative embodiments, however, the taper may extend in the opposite direction such that the rear of the cushion is thinnest and the front of the cushion is thickest. This configuration may be more comfortable for use in connection with particular types of seats or other support platforms.

In this particular embodiment, as also shown in FIG. 6, the taper extends the entire distance from the rearmost edge of cushion 500 to the frontmost edge of cushion 500. However, in alternative embodiments, this taper may extend along only a portion of cushion 500. As another alternative, the cushion may be thinner in the front (or vice versa) by forming a step or other transition in height at one or more positions along the cushion rather than a taper.

In certain preferred embodiments, cushion 500 may comprise a length "L" of between about 12 and about 14 inches. In some such embodiments, cushion 500 may comprise a length "L" of about 13 inches. In certain preferred embodiments, cushion 500 may comprise a width "W" of between about 14 and about 16 inches. In some such embodiments, cushion 500 may comprise a width "W" of about 15 inches.

In certain preferred embodiments, cushion 500 may comprise a rear seat portion 560 having a width "S" of between about 10 and about 12 inches. In some such embodiments, cushion 500 may comprise a rear seat portion 560 having a width "S" of about 11 inches.

In certain preferred embodiments, cushion 500 may comprise a rear seat portion 560 having a length "SL" of between about 4 and about 6 inches. In some such embodiments, cushion 500 may comprise a rear seat portion 560 having a length "SL" of about 5 inches.

Similarly, in certain preferred embodiments, cushion 500 may comprise a front seat portion having a length "LL" of between about 6 and about 8 inches. In some such embodiments, cushion 500 may comprise a front seat portion having a length "LL" of about 7 inches. Thus, some embodiments may comprise a front portion, which may be configured to support a user's legs and, in some embodiments, may be defined by two opposing lobes, such as lobes 570 and 580, that has a greater length than the rear seat portion, such as rear seat portion 560.

In certain preferred embodiments, cushion 500 may comprise a first lobe 570 that extends beyond the width of rear seat portion 560 by a distance "S1" of between about 1 and about 3 inches. In some such embodiments, cushion 500 may comprise a first lobe 570 that extends beyond the width of rear seat portion 560 by a distance "S1" of about 2 inches.

Similarly, in certain preferred embodiments, cushion 500 may comprise a second lobe 580 that extends beyond the width of rear seat portion 560 by a distance "S2" of between about 1 and about 3 inches. In some such embodiments, cushion 500 may comprise a second lobe 580 that extends beyond the width of rear seat portion 560 by a distance "S2" of about 2 inches. In some embodiments, S1 and S2 may be different. However, in preferred embodiments, S1 and S2 are at least substantially identical.

In certain preferred embodiments, cushion 500 may comprise a low-profile region 550 comprising a narrowed region 552 at which lobes 570 and 580 are separated by a minimum distance "NW" of between about 1 and about 3 inches. In some such embodiments, cushion 500 may comprise a low profile region 550 comprising a narrowed region 552 at which lobes 570 and 580 are separated by a minimum distance "NW" of about 2 inches.

In certain preferred embodiments, low-profile region 550 may define a curvature having a diameter of curvature "DC" along at least a portion of low-profile region of between about 2.5 and about 4 inches. In some such embodiments, low-profile region 550 may define a curvature having a diameter of curvature "DC" along at least a portion of low-profile region of about 3.5 inches. In some embodiments, low-profile region 550 may define a circle having a radius of curvature as defined above.

As with other embodiments, cushion 500 may also comprise a valve 510. In some embodiments, valve 510 may comprise a self-inflating valve. In other embodiments, cushion 500 may comprise a compressible material and need not be inflatable. In certain preferred embodiments, cushion 500 may comprise a foam, such as a closed-cell memory foam, that allows it to self-inflate and may further allow for rolling or otherwise compressing cushion 500 into a condensed shape (with valve 510 closed) during storage. With respect to such embodiments, opening valve 510 may increase the volume within the foam to allow cushion 500 to automatically inflate.

FIG. 6 depicts a side view of cushion 500. As shown in this figure, cushion 500 has a height "H1" at a rear end of the cushion and a smaller height "H2" at a front end of the cushion. In certain preferred embodiments, H1 may be between about 2 and about 3.5 inches. In some such embodiments, H1 may be about 3 inches. In certain preferred embodiments, H2 may be between about 1 and about 2 inches. In some such embodiments, H2 may be about 1.5 inches.

Also, it can be seen in FIG. 6 that, due to the difference between H1 and H2, there is a slope between the rear end and the front end of cushion 500. In certain preferred embodiments, this slope may be between about 0.05 and about 0.2. In some such embodiments, this slope may be about 0.1. In other embodiments, as mentioned above, one or more discrete steps may be formed in order to provide for a greater height at the rear (or, as discussed below, at the front) of the cushion 500 than at the front of the cushion. For example, in some embodiments, a step may be formed between rear seat portion 560 and lobes 570 and 580 rather than providing a gradual slope.

In the embodiment depicted in FIGS. 5 and 6, a side wall, separate from the top and bottom pieces shown in FIG. 5, may be hermetically sealed separately to each of the top and bottom pieces of material to provide stability and strength. This side wall material may be cut in size from about 2 to about 3 inches at the rear, and tapered to from about 1 inch to about 2 inches in the front. The side view shown in FIG. 6 depicts this side wall.

In other embodiments, there need not be such a side wall. Instead, the top and bottom pieces of material may be sealed directly to each other. For example, as shown in FIGS. 1A and 1B, cushion 100 may comprise a seal 105 that couples the top surface 101 and the bottom surface 103.

FIG. 6 illustrates a top view of a yet another alternative embodiment of a cushion 700. As with cushion 500, cushion 700 may be configured to be integrated with, be inserted within, be secured to, or rest on one or more accessories or other peripheral structures, such as an underlying support platform. Cushion 700 may also be configured as an inflatable cushion that may be automatically or manually inflated with a gas, such as air. In some such embodiments, cushion 700 may be self-inflating. In alternative embodiments, a cushion may be filled or stuffed with a compressible material or semi-compressible material, such as foam or gel.

However, cushion 700 differs from cushion 500 in that cushion 700 comprises different shape and a sloping in an opposite direction to that of cushion 500. More particularly, it is contemplated that, although the slope is in an opposite direction, users would likely turn cushion 700 around such that the slope is still in the same direction relative to a user and such that the slope assists in providing a curvature to the user's spine that may further relieve pressure and/or pain. In other words, with respect to cushion 500, the side from which valve 510 extends is considered the rear end such that rear end portion 560 supports a user's buttocks and lobes 570 and 580 support the user's legs. However, with respect to cushion 700, the side from which valve 710 extends is considered the front end such that front seat portion 760 supports the user's legs and lobes 770 and 780 support the user's buttocks.

Cushion 700 comprises an upper surface comprising a front seat portion 760, a first lobe 770 and a second lobe 770. Lobes 770 and 780 are separated by a low-profile region 750. Cushion 700 comprises a low-profile region 750 that completely separates lobes 770 and 780. In other words, low-profile region 750 comprises an empty region positioned in between lobes 770 and 780. However, alternative embodiments are contemplated in which low-profile region 750 comprises a region in which lobes 770 and 780 are directly attached to one another (rather than spaced apart), but in which the height of the cushion is reduced.

Figure 7:
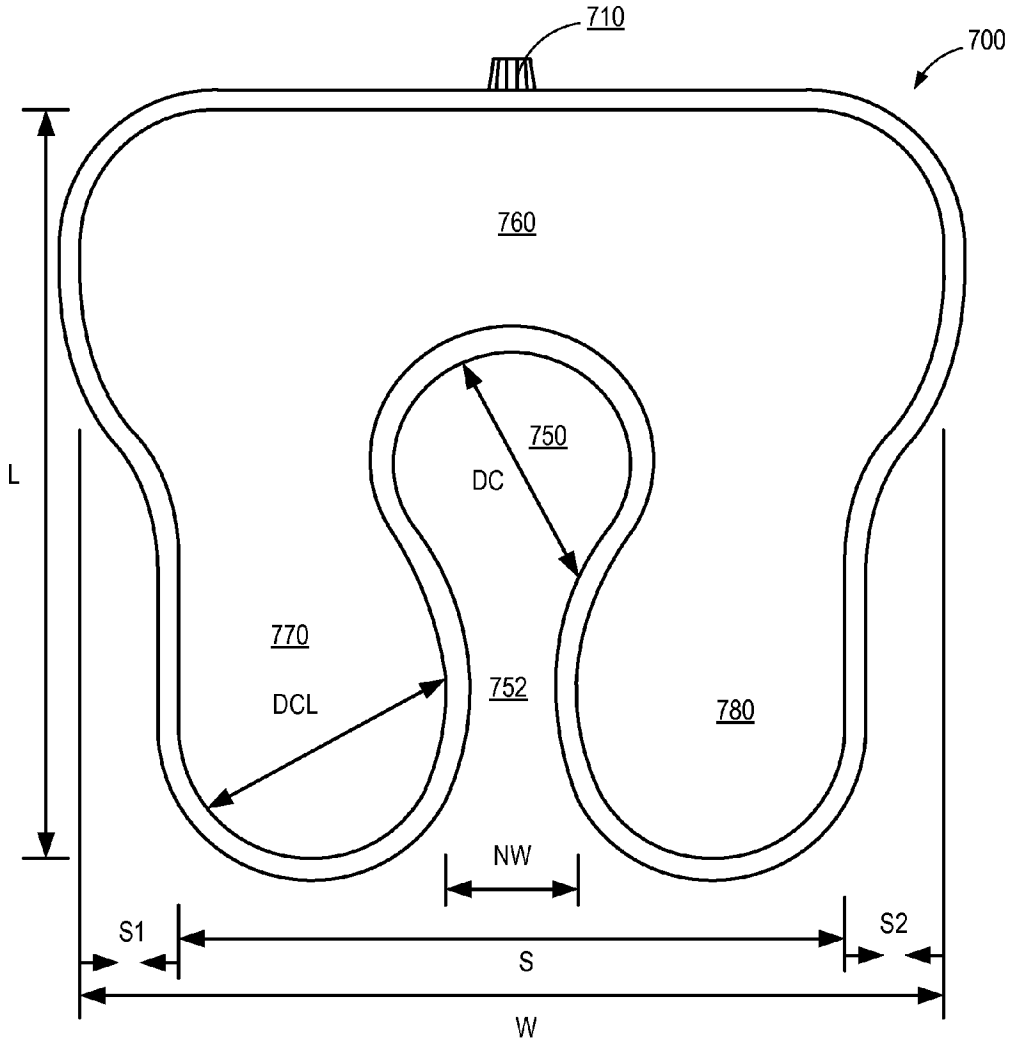
FIG. 7 illustrates a top view of yet another embodiment of a cushion for relieving pressure in the piriformis muscle/sciatic nerve area and/or perineum pressure.

It can also be seen in FIG. 7 that low-profile region 750 comprises a curved region immediately adjacent to front seat portion 760. In the depicted embodiment, this curved region comprises an at least partially circular shape. However, other embodiments are contemplated in which this region is curved but not circular, or not curved at all. Low-profile region 750 also comprises a narrowed region 752 positioned towards the front of cushion 700 relative to the circular region of low-profile region 550 in the shape of a key hole.

As with cushion 500, lobes 770 and 780 are widened on one side to create narrowed region 752. However, in contrast to cushion 500, lobes 770 and 780 of cushion 700 are also narrower on the sides opposite to the sides defining narrowed region 752 than front seat portion 760. Otherwise stated, as referenced in greater detail below, lobes 770 and 780 collectively define a width "S" that is less than the width "W" of front seat portion 760.

Figure 8:
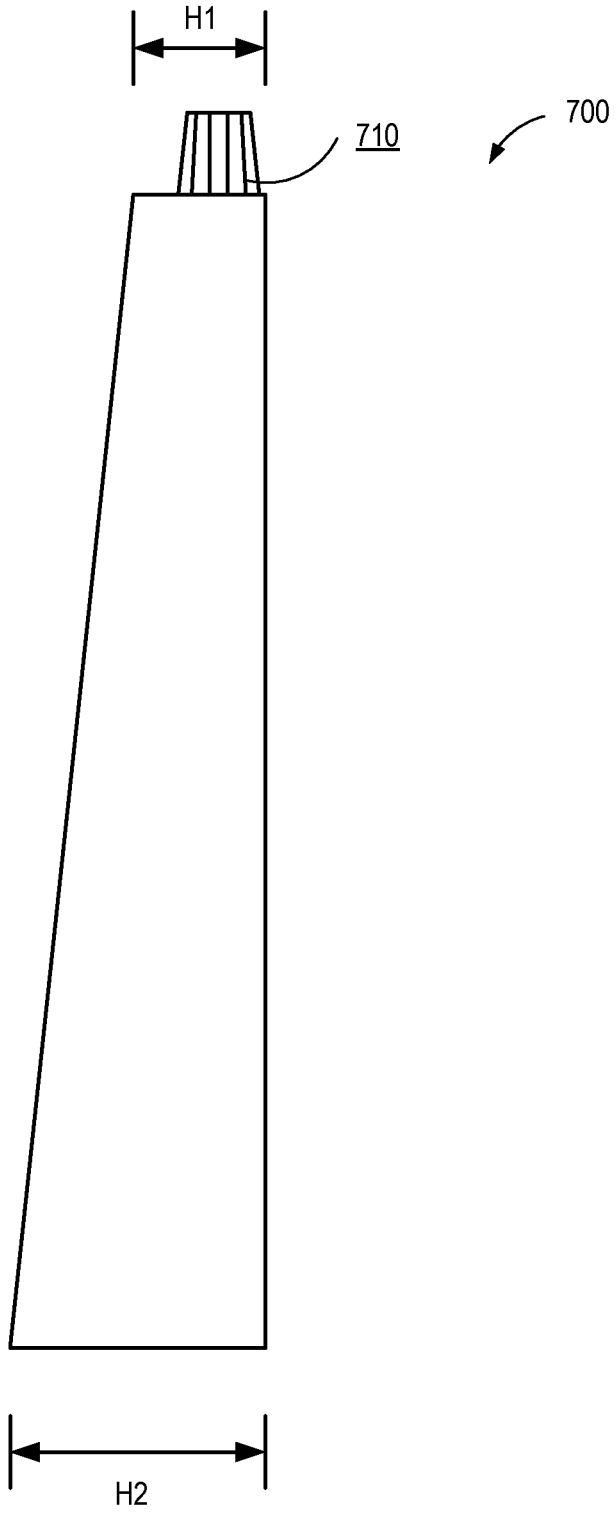
FIG. 8 illustrates a side view of the cushion of FIG. 7.

Cushion 700 also comprises a tapered or wedge shape, as depicted in the side view of FIG. 8. More particularly, cushion 700 is tapered or wedge shaped from the front to the back of cushion 500 (with the front having the greatest height and the back having the smallest height). This configuration may be more comfortable for use in connection with particular types of seats or other support platforms, or in connection with particular back conditions, relative to the opposite sloping of cushion 500.

The taper on cushion 700 extends the entire distance from the rearmost edge of cushion 700 to the frontmost edge of cushion 700. However, in alternative embodiments, this taper may extend along only a portion of cushion 700, or may be stepped at one or more locations to create a height differential.

In certain preferred embodiments, cushion 700 may comprise a length "L" of between about 12 and about 14 inches. In some such embodiments, cushion 700 may comprise a length "L" of about 13 inches. In certain preferred embodiments, cushion 700 may comprise a width "W" of between about 14 and about 16 inches. In some such embodiments, cushion 700 may comprise a width "W" of about 15 inches. Cushion 700 has a width "W" that is identical to, and coincident with, the width of front seat portion 760.

In certain preferred embodiments, cushion 700 may comprise front lobes 770 and 770 that collectively have a width "S" of between about 10 and about 12 inches. In some such embodiments, cushion 700 may comprise front lobes 770 and 770 that collectively have a width "S" of about 11 inches.

In certain preferred embodiments, cushion 700 may comprise a first lobe 770 that is inset from front end portion 560 by a distance "S1" of between about 1 and about 3 inches.

In some such embodiments, cushion 700 may comprise a first lobe 770 that is inset from front seat portion 760 by a distance "S1" of about 2 inches.

Similarly, in certain preferred embodiments, cushion 700 may comprise a second lobe 780 that is inset from front seat portion 760 by a distance "S2" of between about 1 and about 3 inches. In some such embodiments, cushion 700 may comprise a second lobe 780 that is inset from front seat portion 760 by a distance "S2" of about 2 inches. In some embodiments, S1 and S2 may be different. However, in preferred embodiments, S1 and S2 are at least substantially identical.

In certain preferred embodiments, cushion 700 may comprise a low-profile region 750 comprising a narrowed region 752 at which lobes 770 and 780 are separated by a minimum distance "NW" of between about 1 and about 3 inches. In some such embodiments, cushion 700 may comprise a low profile region 750 comprising a narrowed region 752 at which lobes 770 and 780 are separated by a minimum distance "NW" of about 2 inches.

In certain preferred embodiments, low-profile region 750 may define a curvature having a diameter of curvature "DC" along at least a portion of low-profile region of between about 2.5 and about 4 inches. In some such embodiments, low-profile region 750 may define a curvature having a diameter of curvature "DC" along at least a portion of low-profile region of about 3.5 inches. In some embodiments, low-profile region 750 may define a circle having a diameter of curvature as defined above.

Cushion 700 also comprises lobes 770 and 780 each of which comprises another diameter of curvature "DCL." In certain preferred embodiments, DCL may be between about 4 and about 4.5 inches. In some such embodiments, DCL may be about 4.25 inches.

Cushion 700 may also comprise a valve 710. In some embodiments, valve 710 may comprise a self-inflating valve. In some embodiments, valve 710 may be placed on another portion of cushion 700, such as on the opposite side of cushion 700 as is shown in FIG. 7. In other words, valve 710 may be positioned on a rear end of cushion 700 as valve 510 is positioned on cushion 500. In other embodiments, cushion 700 may comprise a compressible material and need not be inflatable.

FIG. 8 depicts a side view of cushion 700. As shown in this figure, cushion 700 has a height "H1" at a front end of the cushion and a height "H2" at a rear end of the cushion. However, unlike cushion 500, cushion 700 comprises an opposite slope such that H2 is greater than H1. In certain preferred embodiments, H1 may be between about 1 and about 2 inches. In some such embodiments, H1 may be about 1.5 inches. In certain preferred embodiments, H2 may be between about 2 and about 3.5 inches. In some such embodiments, H2 may be about 3 inches.

In the embodiment depicted in FIGS. 7 and 8, a side wall, separate from the top and bottom pieces shown in FIG. 5, may be hermetically sealed separately to each of the top and bottom pieces of material to provide stability and strength. This side wall material may be cut in size from about 2 to about 3 inches at one end, and tapered to from about 1 inch to about 2 inches in the opposite end. The side view shown in FIG. 8 depicts this side wall.

In other embodiments, there need not be such a side wall. Instead, the top and bottom pieces of material may be sealed directly to each other. For example, as shown in FIGS. 1A and 1B, cushion 100 may comprise a seal 105 that couples the top surface 101 and the bottom surface 103.

Also, it can be seen in FIG. 8 that, due to the difference between H1 and H2, there is a slope between the rear end and the front end of cushion 700. In certain preferred embodiments this slope may be between about 0.05 and about 0.2. In some such embodiments, this slope may be about 0.1.

In some embodiments, including any of the specific embodiments depicted in the drawings, the cushion may be configured to be adjustable to allow a user to adjust certain aspects of the cushion to accommodate certain body types, preferences, and/or medical conditions. For example, in some embodiments comprising lobes, the lobes may be adjustable such that a user can adjust the distance between the lobes. This may be accomplished in some embodiments by providing a suitable foam, such as a closed-cell memory foam, that allows a user to manipulate the lobes, or another portion or portions of the cushion. Some such embodiments may comprise a cover over the memory foam to allow for introduction of air into the cushion. This may allow a user to compress the foam and seal a valve to reduce the size of the cushion for storage, and may also provide a self-inflating functionality. This may also allow a user to adjust one or more portions of the cushion according to personal preference, medical conditions, body types, etc., such as the lobes of the cushion.

The foregoing specification has been described with reference to various embodiments. However, one of ordinary skill in the art will appreciate that various modifications and changes can be made without departing from the scope of the present disclosure. Accordingly, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, a required, or an essential feature or element. The scope of the present invention should, therefore, be determined only by the following claims.

The invention claimed is:

1. A seat cushion, comprising:

a first lobe configured to be inflated, wherein the first lobe comprises a first height after being inflated;

a second lobe configured to be inflated, wherein the second lobe comprises a second height after being inflated;

a bridge connecting the first lobe to the second lobe, such that respective peripheral edges of the first lobe, the second lobe, and the bridge collectively define a low-profile region, wherein the low-profile region comprises a reduced height relative to the first height and the second height, and wherein the bridge comprises a first width defined by at least substantially parallel opposing edges; and a valve configured to inflate at least one of the first lobe, the second lobe, and the bridge, wherein the first lobe and the second lobe collectively define a widened region near a front of the seat cushion, wherein the widened region is configured to support a user's legs during use, wherein the widened region comprises a second width greater than the first width, and wherein the widened region is defined by opposing edges that are connected to the at least substantially parallel opposing edges by opposing transitional regions that expand the seat cushion from the first width to the second width.

2. The seat cushion of claim 1, wherein the low-profile region comprises an empty region positioned in between the first lobe and the second lobe.

3. The seat cushion of claim 1, wherein the first lobe is in direct contact with the second lobe within the low-profile region.

4. The seat cushion of claim 3, further comprising a seam in contact with the first lobe and the second lobe within the low-profile region, such that the seam separates the first lobe from the second lobe.

5. The seat cushion of claim 1, wherein the first lobe extends beyond the first width of the bridge by a distance of between about 1 and about 3 inches along a first transitional region of the opposing transitional regions.

6. The seat cushion of claim 5, wherein the second lobe extends beyond the first width of the bridge by a distance of between about 1 and about 3 inches in a direction opposite from that of the first lobe along a second transitional region of the opposing transitional regions.

7. A seat cushion, comprising:

a first lobe configured to be inflated, wherein the first lobe comprises a first height after being inflated;

a second lobe configured to be inflated, wherein the second lobe comprises a second height after being inflated, wherein the first lobe and the second lobe are configured to support a user's buttocks during use;

a front seat portion comprising a bridge connecting the first lobe to the second lobe, wherein the front seat portion is configured to support a user's legs during use, and wherein the front seat portion comprises a third height; and a valve configured to inflate at least one of the first lobe, the second lobe, and the front seat portion, wherein the first lobe and the second lobe collectively define a first width measured between at least substantially parallel opposing edges of the first lobe and the second lobe that is less than a second width of the front seat portion defined by opposing edges of the front seat portion, and wherein the at least substantially parallel opposing edges of the first lobe and the second lobe are connected to the opposing edges of the front seat portion by opposing transitional regions that expand the seat cushion from the second width to the first width.

8. The seat cushion of claim 7, wherein the third height is less than the second height, and wherein the third height is less than the first height.

9. The seat cushion of claim 8, wherein the seat cushion comprises a slope from a front end of the front seat portion to a rear end of the first and second lobes.

10. A seat cushion, comprising:

a front seat portion configured to support a user's legs during use, wherein the front seat portion comprises a first width;

a rear seat portion configured to support a user's buttocks during use, wherein the rear seat portion comprises a second width, and wherein the second width is less than the first width, wherein one of the first width and the second width is defined by opposing at least substantially parallel edges, and wherein opposing edges defining the other one of the first width and the second width are connected to the at least substantially parallel opposing edges by opposing transitional regions that expand the seat cushion from the second width to the first width;

a first lobe configured to be inflated;

a second lobe configured to be inflated, wherein the first lobe is positioned adjacent to the second lobe; and a low-profile region positioned in between the first lobe and the second lobe.

11. The seat cushion of claim 10, wherein the front seat portion comprises the first lobe and the second lobe such that the first lobe and the second lobe collectively define the first width.

12. The seat cushion of claim 11, wherein the first lobe extends beyond the second width.

13. The seat cushion of claim 12, wherein the second lobe extends beyond the second width.

14. The seat cushion of claim 13, wherein the first lobe extends beyond the second width by a distance of between about 1 inch and about 3 inches, and wherein the second lobe extends beyond the second width by a distance of between about 1 inch and about 3 inches such that the first width is between about 2 inches and about 6 inches greater than the second width.

15. The seat cushion of claim 11, wherein the first width is between about 2 inches and about 6 inches greater than the second width.

16. The seat cushion of claim 11, wherein the low-profile region is defined by a first region and a second region, wherein the second region comprises a narrowed region relative to the first region such that the first lobe is closer to the second lobe in the narrowed region.

17. The seat cushion of claim 16, wherein the first region comprises a curved region having a diameter of curvature, and wherein the low-profile region comprises a key-hole-like shape defined by the curved region and the narrowed region.

18. The seat cushion of claim 17, wherein the diameter of curvature is between about 2.5 inches and about 4 inches.

19. The seat cushion of claim 11, wherein the front seat portion comprises a first length extending at least substantially perpendicular to the first width, wherein the rear seat portion comprises a second length extending at least substantially perpendicular to the second width, and wherein the first length is greater than the second length.

20. The seat cushion of claim 19, wherein the first length is between about 6 inches and about 8 inches, and wherein the second length is between about 4 inches and about 6 inches.

* * * * *